US008550547B1

(12) United States Patent
Liu et al.

(10) Patent No.: US 8,550,547 B1
(45) Date of Patent: Oct. 8, 2013

(54) TRANSFORMABLE CHAIR EQUIPPED WITH A MOVABLE DECK

(75) Inventors: Lausan Chung-Hsin Liu, Shanghai (CN); Shopo Hsin Tsu Liu, Shanghai (CN); Fibro Tsu Kun Liu, Shanghai (CN)

(73) Assignee: Keysheen Industry (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/571,092

(22) Filed: Aug. 9, 2012

(51) Int. Cl.
*A47B 85/04* (2006.01)

(52) U.S. Cl.
USPC ..... 297/121; 297/124

(58) Field of Classification Search
USPC ..... 297/119, 118, 121, 124, 158.3, 158.4
See application file for complete search history.

(56) References Cited

U.S. PATENT DOCUMENTS 2,145,201 A * 1/1939 Raeuber ..... 297/142
2,618,314 A * 11/1952 Jerdee ..... 297/121
2,631,653 A * 3/1953 Woodley ..... 297/158.4
3,429,283 A * 2/1969 Uhor ..... 108/11
4,382,627 A * 5/1983 Dean ..... 297/124
4,647,107 A * 3/1987 Hoover et al. ..... 297/124
7,429,077 B2 * 9/2008 Yul ..... 297/124

FOREIGN PATENT DOCUMENTS

DE 202011003252 5/2011
TW 529385 4/2003

* cited by examiner

*Primary Examiner* — Milton Nelson, Jr.
(74) *Attorney, Agent, or Firm* — Muncy, Geissler, Olds & Lowe, PLLC

(57) ABSTRACT

A transformable chair equipped with a movable deck comprises a frame, a movable unit and two chair units. The frame includes two posts, a transverse bar rotatably coupled with the two posts and two holding bars connected to the transverse bar. The movable unit includes a movable deck and a movable rack pivotally coupled with the movable deck and holding bars. The two chair units are pivotally coupled with the two posts and form a second rotary displacement against the frame. The movable deck has a moving displacement against the two posts. The movable rack can proceed a flipping displacement during the moving displacement against the two holding bars to drive the two holding bars to form a first rotary displacement so that the movable deck can form an unfolding state away from the transverse bar and a folding state leaning on the transverse bar.

8 Claims, 6 Drawing Sheets

TRANSFORMABLE CHAIR EQUIPPED WITH A MOVABLE DECK

FIELD OF THE INVENTION

The present invention relates to a chair changeable to varying states according to user's requirements and particularly to a transformable chair equipped with a movable deck.

BACKGROUND OF THE INVENTION

Urbanization is a growing trend with increasing of population in metropolitans regions. Smaller houses become gradually popular. How to create maximum utilization value in a limited space has become a growing concern of furniture producers. In addition, different design trends also pioneer varying types of furniture in the market. For instance, Scandinavian furniture features simple style, namely it often is integratedly formed and has simple and neat profiles. The furniture thus formed generally is deficient in diversity and cannot meet the versatile requirements of many people. Some furniture are made with eco-friendly concept and even made of corrugated cardboards. They are not durable and not waterproof, and mostly provide a single function. The aforesaid furniture make appearance and energy-saving and carbon reduction as the main appeal, they cannot thoroughly resolve the problem of lack usable living space of modern people.

To remedy the aforesaid problem, many types of composite chairs equipped with table function have been developed on the market. For instance, R.O.C. utility model No. 529385 discloses a chair equipped with a holding rack capable of flipping. It includes a chair bracket, a chair frame installed on the chair bracket, a seat pad mounted onto the chair frame and a holding rack. The holding rack has a swivel frame which can be flipped rearwards. The chair frame has a rear leaning bar to anchor the swivel frame. The swivel frame has a leaning end at the front side to enable it to be positioned at a horizontal position so that the holding rack can hold goods. When the leaning end of the swivel frame is at a flipping position, the entire holding rack can be flipped rearwards, and the seat pad can seat people.

Germany publication No. DE202011003252 discloses another type of the composite chair. It includes an elongate bench divided into a middle portion and two side portions. The middle portion is a movable carrying deck which has a first position for seating people and a second position for holding goods. Through a simple operation process, the elongate bench can serve as a chair for three persons, also can be changed to a composite table and chair for two persons.

The aforesaid composite chairs mainly include a movable unit and two fixed units at two sides of the movable units. The movable unit can be changed to different use states according to user's requirements. However, the two fixed units cannot be adjusted relative to the movable unit in response to the use states. As a result, those composite chairs can provide only a few use states. There are still rooms for improvement in terms of structural transformation.

SUMMARY OF THE INVENTION

The primary object of the present invention is to provide a composite chair with greater structural transformation and capable of providing multiple use states.

To achieve the foregoing object, the invention provides a transformable chair equipped with a movable deck. The transformable chair comprises a frame, a movable unit and two chair units. The frame includes two posts, a transverse bar rotatably coupled with the two posts and two holding bars connected to the transverse bar. The movable unit includes a movable deck and a movable rack pivotally coupled with the movable deck and the two holding bars. The movable deck has two first hinges pivotally coupled with the two posts. The movable rack has two second hinges pivotally coupled with the two holding bars.

The movable deck has a moving displacement against the two posts at the two first hinges. The movable rack has a flipping displacement during the moving displacement against the two holding bars at the two second hinges to drive the two holding bars to proceed a first rotary displacement about the transverse bar so that the movable deck forms an unfolding state away from the transverse bar, and a folding state leaning on the transverse bar. The two chair units are pivotally coupled respectively with the two posts and form a second rotary displacement against the two posts of the frame.

In one embodiment the movable rack includes at least one detent portion blocked by the holding bars in the flipping displacement so that the movable deck is stopped at the unfolding state.

In another embodiment each holding bar has a wrench portion hinged thereon to anchor the detent portion and hold the movable deck at the unfolding state.

In yet another embodiment the frame includes at least one assembly bar bridging the two posts and parallel with the transverse bar.

In yet another embodiment each chair unit includes a plurality of legs and a carrying portion mounted onto the legs.

In yet another embodiment each post has at least one connecting member, and the carrying portion has at least one strut running through the connecting member.

In yet another embodiment the two chair units have respectively a male coupler and a female coupler insertable by the male coupler.

In yet another embodiment the movable deck has a C-shaped clip to hold the movable rack.

Through the structure set forth above, compared with the conventional techniques, the invention provides many advantages, notably:

Providing many use states. Each chair unit can be moved in the second rotary displacement against the post of the frame. Hence the chair unit can be adjusted against the movable unit in response to different use states. For instance, the chair units can be incorporated with the movable deck to form an elongate chair to seat two persons abreast at the folding state. The chair units can also be incorporated with the movable deck to form a picnic table with two separated chairs at the unfolding state. In addition, the chair units also can be rotated against the frame to form varying positions. Hence it has a greater structural transformation. Compared with the conventional composite chairs, the invention is more versatile and adaptable to a wider range of different use requirements.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
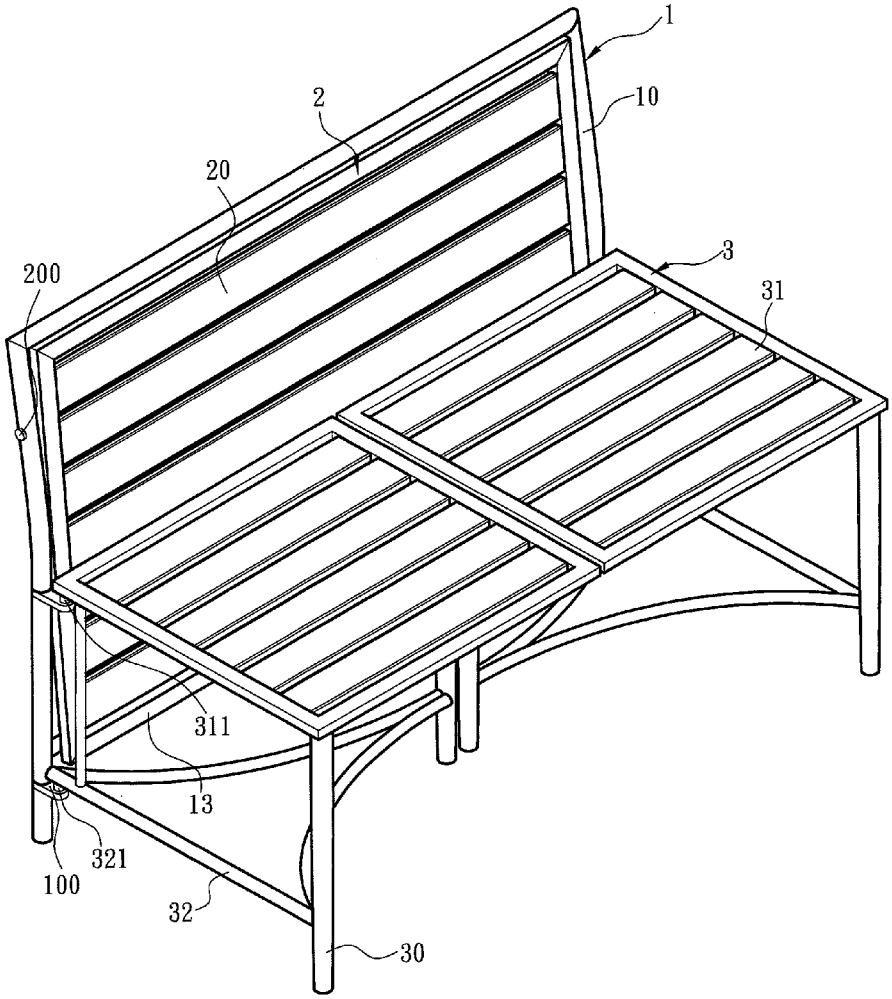
FIG. 1 is a perspective view of an embodiment of the invention at a first use state.
Figure 2:
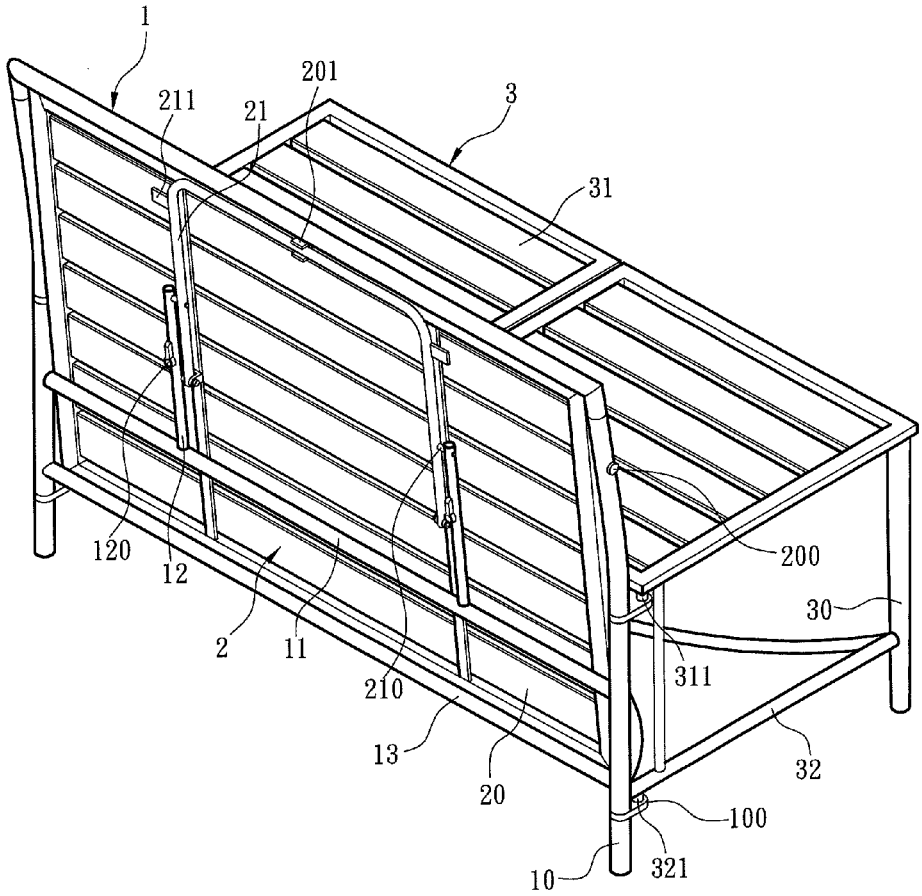
FIG. 2 is another perspective view of an embodiment of the invention at the first use state.

Please refer to FIGS. 1 and 2 for an embodiment of the transformable chair of the invention. The transformable chair comprises a frame 1, a movable unit 2 and two chair units 3.

As shown in FIG. 2, the frame 1 includes two posts 10, a transverse bar 11, two holding bars 12 and at least one assembly bar 13. The transverse bar 11 is connected to the two holding bars 12 and rotatably coupled with the two posts 10. The assembly bar 13 bridges the two posts 10 and parallel with the transverse bar 11. The movable unit 2 includes a movable deck 20 and a movable rack 21. The movable rack 21 is pivotally coupled with the movable deck 20 and the holding bars 12. The movable deck 20 has a C-shaped clip 201 to hold the movable rack 21. Referring to FIG. 1, each of the two chair units 3 includes a plurality of legs 30 and a carrying portion 31 mounted onto the legs 30. The carrying portion 31 allows people to sit thereon. Each chair unit 3 further has a plurality of connecting bars 32 to bridge the legs 30 to prevent the legs 30 from separating the carrying portion 31 due to heavy loading. Furthermore, each post 10 has at least one connecting member 100 extended therefrom. The carrying portion 31 and connecting bar 32 include respectively a strut 311 and 321 running through the connecting members 100, thereby the two chair units 3 can rotate about the two posts 10 against the frame 1 in a second rotary displacement.

Figure 3A:
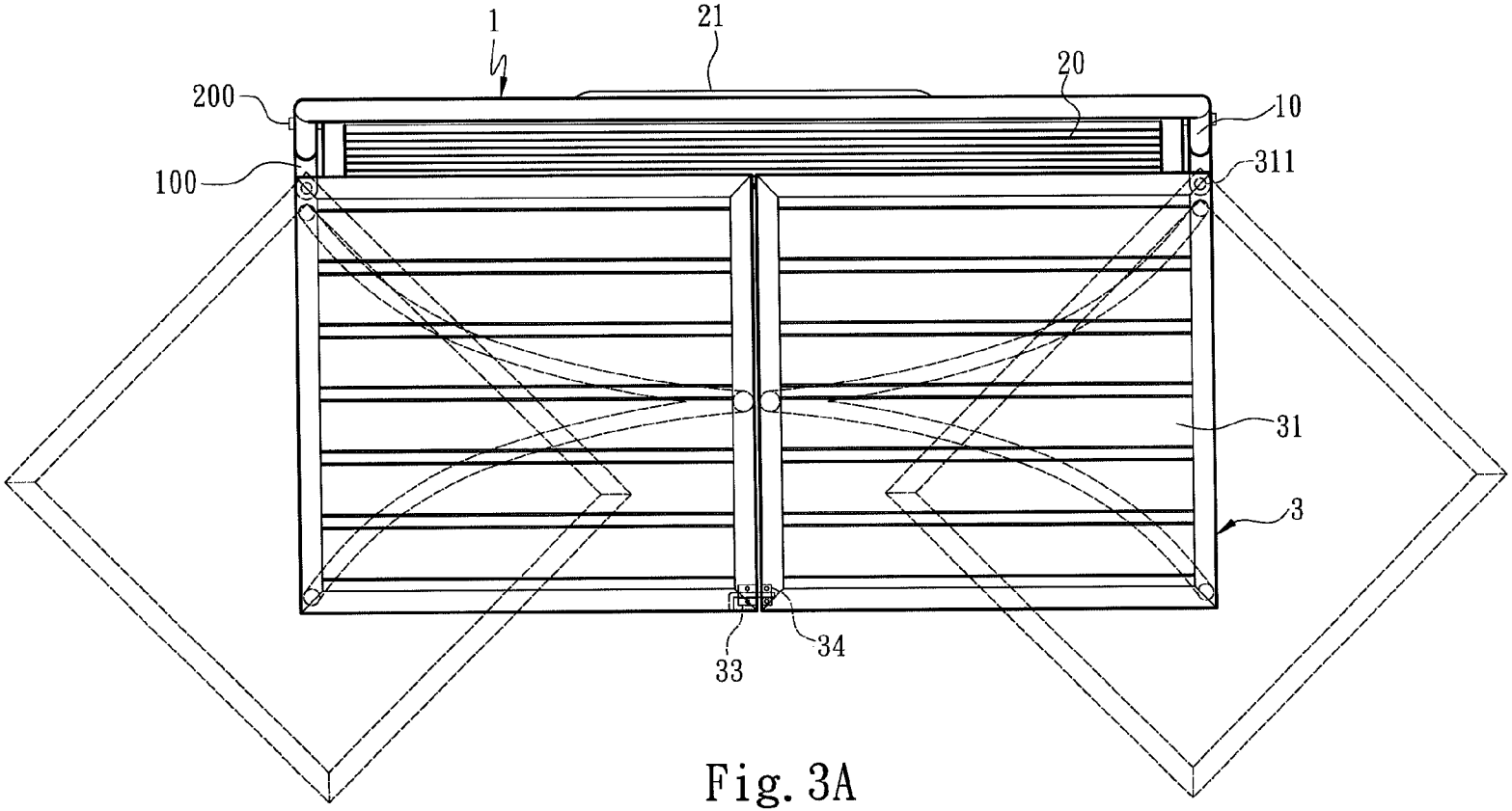
FIG. 3A is a top view of an embodiment of the invention in a movement condition.
Figure 3B:
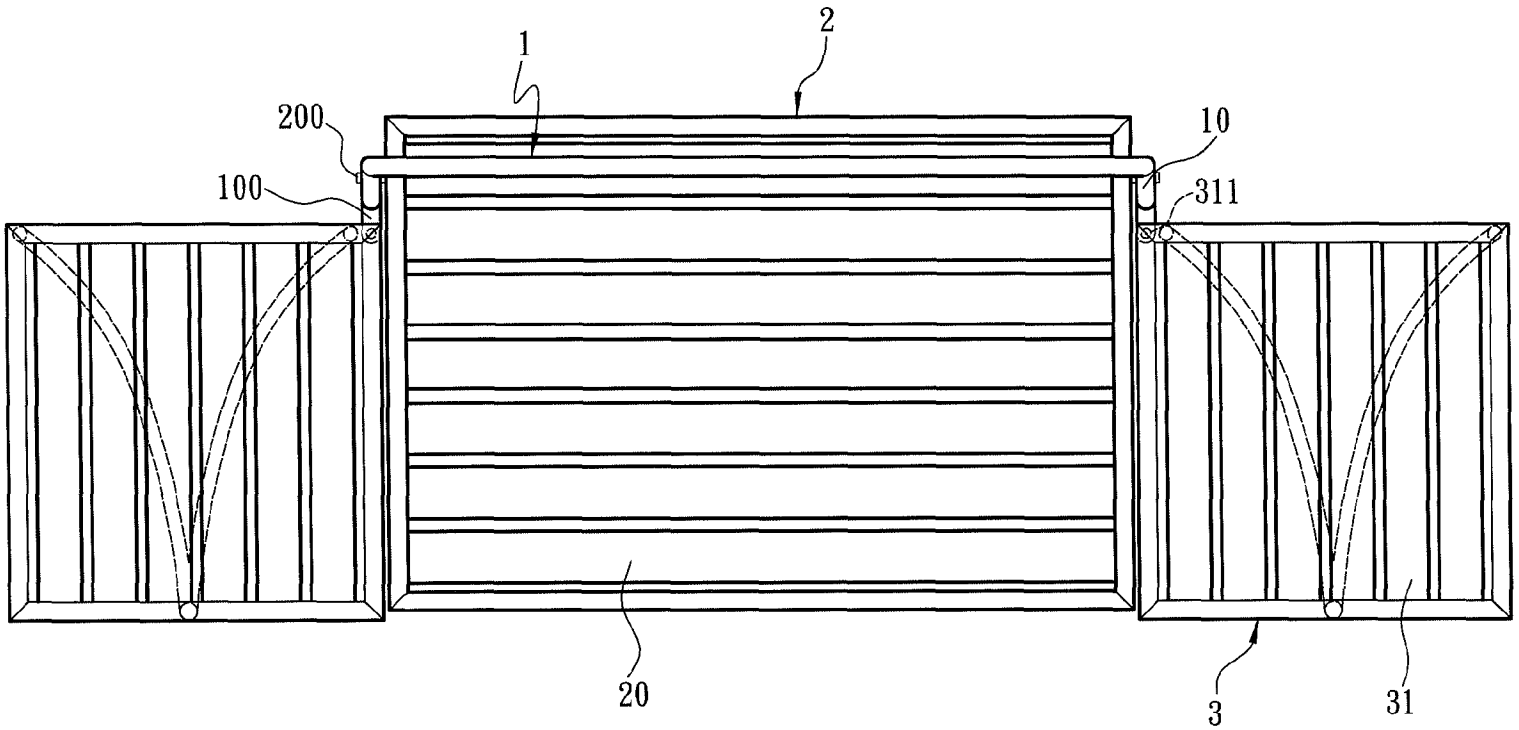
FIG. 3B is a top view of an embodiment of the invention at a second use state.
Figure 4:
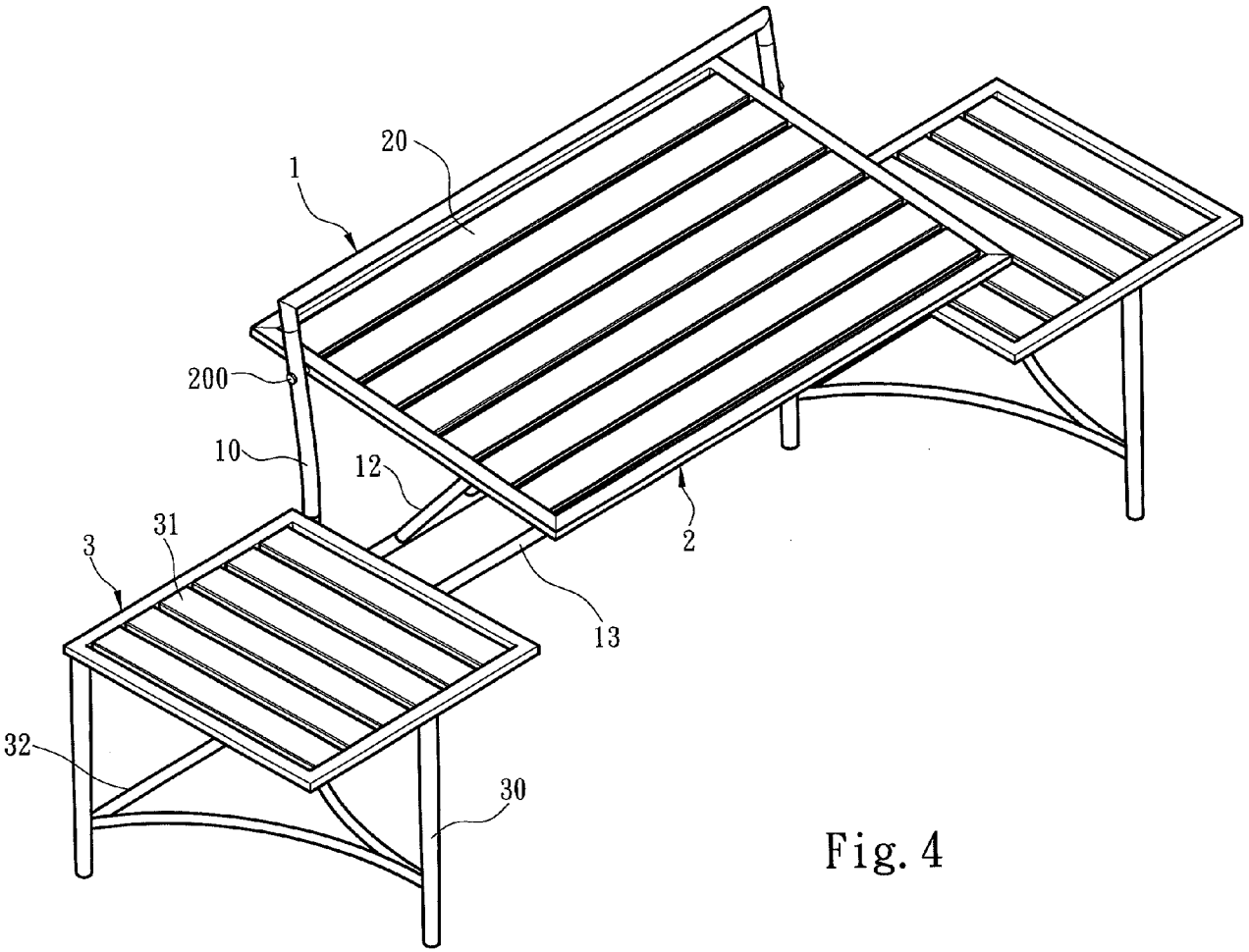
FIG. 4 is a perspective view of an embodiment of the invention at the second use state.

Referring to FIG. 2, the movable unit 2 is movable and changeable to varying use states. To transform the transformable chair from a first use state to a second use state, the movable deck 20 includes two first hinges 200 pivotally coupled with the two posts 10. The movable rack 21 has two second hinges 210 pivotally coupled with the two holding bars 12. Details of transforming the movable deck 20 from a folding state as shown in FIG. 2 to an unfolding state as shown in FIG. 4 are elaborated as follows:

First, referring to FIG. 3A, when the transformable chair is at the first use state, the two chair units 3 are coupled closely by inserting a male coupler 33 into a female coupler 34, hence the two chairs units 3 are prevented from rotating against the two posts 10 and separating under external forces. Through the C-shaped clip 201, the movable deck 20 can be latched on the movable rack 21 tightly. At the first use state, the movable deck 20 and the two chair units 3 become an elongate chair with a backrest at the folding state. While transforming the transformable chair from the first use state to the second use state is desired, in order to prevent the movable deck 20 from being hindered by the two chair units 3 and unable to proceed the moving displacement at the first hinges 200, referring to FIGS. 3A and 3B, the two chair units 3 must be rotated first about the two posts 10 to proceed the second rotary displacement away from the movable deck 20 so that there is a space formed at one side of the frame 1 to allow the movable deck 20 to rotate about the first hinges 200.

Figure 3C:
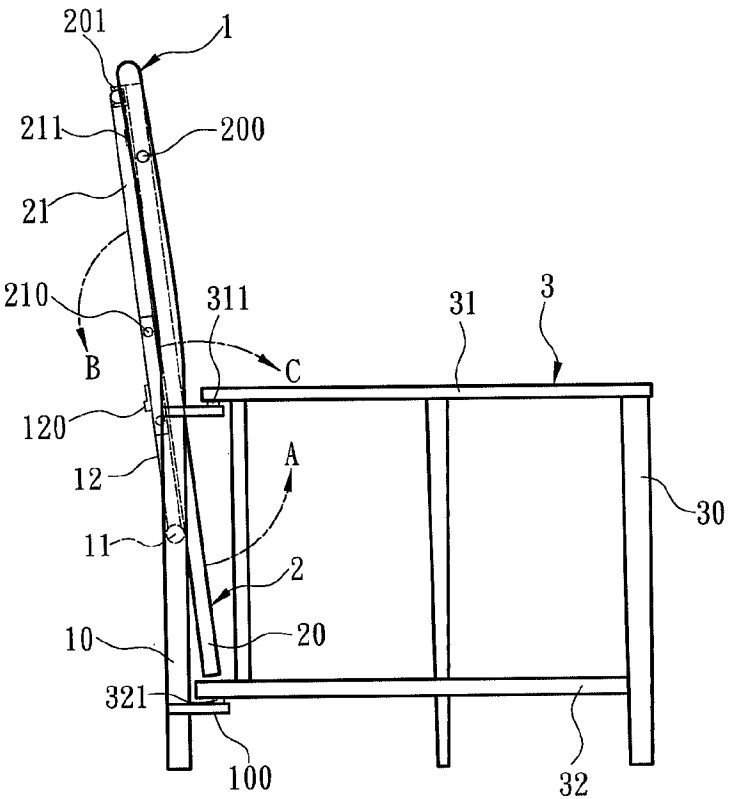
FIG. 3C is a side view of an embodiment of the invention at the first use state.
Figure 3D:
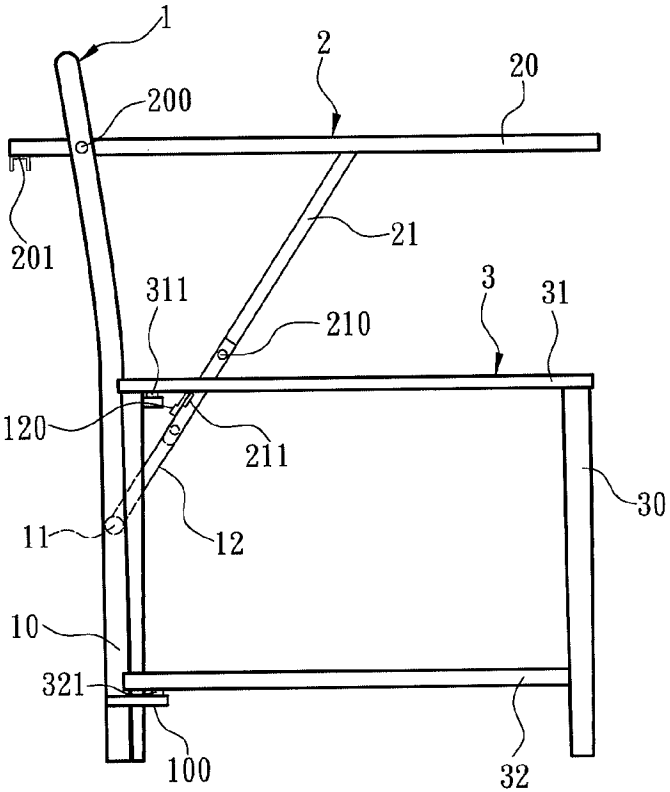
FIG. 3D is a side view of an embodiment of the invention at the second use state.

Referring to FIGS. 2, 3C and 3D, the movable deck 20 proceeds a moving displacement A about 90 degrees against the two posts 10 at the two first hinges 200; during the moving displacement A, the movable rack 21 escapes from the C-shaped clip 201 and goes through a flipping displacement B approximate 180 degrees against the two holding bars 12 at the two second hinges 210 to drive the two holding bars 12 to proceed a first rotary displacement C at an angle smaller than 90 degrees about the transverse bar 11; finally, referring to FIG. 3D, the movable deck 20 escapes from the transverse bar 11 to form an unfolding state for holding goods; meanwhile, the two chair units 3 are also provided for seating people at the second use state.

It is to be noted that, as shown in FIG. 2, the movable rack 21 can rotate at most 180 degrees in the flipping displacement. The movable rack 21 further has at least one detent portion 211 blocked by the holding bars 12 in the flipping displacement B so that the movable deck 20 is driven by the movable rack 21 and stopped at the unfolding state. To prevent the movable deck 20 from dropping from the unfolding state to the folding state because of drawing of gravity, each holding bar 12 further has a wrench portion 120 hinged thereon. When maintaining the movable deck 20 still at the unfolding state is desired, the wrench portion 120 is twisted to parallel with the holding bar 12 to contact with the detent portion 211 as shown in FIG. 3D, thus the detent portion 211 is anchored on the holding bar 12 to make the movable deck 20 be positioned at the unfolding state, thereby the movable deck 20 does not fall to the folding state, and the risk of goods falling from the movable deck 20 to hurt people also can be prevented. To change the movable deck 20 from the unfolding state to the folding state, the wrench portion 120 is twisted to make the movable deck 20 escape from the detent portion 211, thus the transformable chair can be returned to the first use state by performing the steps opposite to the operation sequence previously discussed.

As a conclusion, the movable unit of the invention can proceed the first rotary displacement through the two holding bars moving against the two posts about the transverse bar so that the movable rack can proceed the flipping displacement against the two holding bars at the two hinges to drive the movable deck to move in the moving displacement about the two first hinges. Through the aforesaid operation, the movable deck can be transformed easily between the unfolding state and folding state. Incorporated with the two chair units that proceed the second rotary displacement against the frame, the transformable chair of the invention can be transformed into an elongate chair at the first use state and a composite table and chair at the second use state. Moreover, at the second use state the positions of the two chair units can be adjusted according to different requirements. Compared with the conventional composite chairs, the invention provides a greater structural versatility and offers significant improvements over the conventional techniques.

While the preferred embodiment of the invention has been set forth for the purpose of disclosure, it is not the limitation of the invention, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A transformable chair equipped with a movable deck, comprising:

a frame including two posts, a transverse bar rotatably coupled with the two posts and two holding bars connecting to the transverse bar;

a movable unit including a movable deck and a movable rack pivotally coupled with the movable deck and the two holding bars; the movable deck including two first hinges pivotally coupled with the two posts, the movable rack including two second hinges pivotally coupled with the two holding bars, the movable deck including a moving displacement against the two posts at the two first hinges, the movable rack including a flipping displacement during the moving displacement against the two holding bars at the two second hinges to drive the two holding bars to proceed a first rotary displacement with the transverse bar so that the movable deck forms an unfolding state away from the transverse bar and a folding state leaning on the transverse bar; and two chair units pivotally coupled respectively with the two posts and forming a second rotary displacement against the two posts of the frame.

2. The transformable chair of claim 1, wherein the movable rack includes at least one detent portion blocked by the holding bars in the flipping displacement so that the movable deck is stopped at the unfolding state.

3. The transformable chair of claim 2, wherein each of the holding bars includes a wrench portion hinged thereon to anchor the detent portion on the holding bar to hold the movable deck at the unfolding state.

4. The transformable chair of claim 1, wherein the frame includes at least one assembly bar bridging the two posts and parallel with the transverse bar.

5. The transformable chair of claim 1, wherein each of the two chair units includes a plurality of legs and a carrying portion mounted onto the plurality of legs.

6. The transformable chair of claim 5, wherein each of the two posts includes at least one connecting member, the carrying portion including at least one strut running through the connecting member.

7. The transformable chair of claim 1, wherein the two chair units include respectively a male coupler and a female coupler insertable by the male coupler.

8. The transformable chair of claim 1, wherein the movable deck includes a C-shaped clip to hold the movable rack.

* * * * *